United States Patent [19]

Klang

[11] Patent Number: 4,846,500

[45] Date of Patent: Jul. 11, 1989

[54] BOOK COVER

[76] Inventor: Kathy A. Klang, 1857 Siesta Dr., Sarasota, Fla. 34239

[21] Appl. No.: 115,875

[22] Filed: Nov. 2, 1987

[51] Int. Cl.[4] ..... B42D 3/04; B42D 3/00; B42F 13/06

[52] U.S. Cl. ..... 281/34; 281/33; 402/15

[58] Field of Search ..... 281/4, 17, 19 R, 29, 281/30, 31, 32, 33, 34, 35, 36; 402/15

[56] References Cited

U.S. PATENT DOCUMENTS

| | | | |
|---|---|---|---|
| 382,719 | 5/1888 | Morgan | 281/34 |
| 1,568,723 | 1/1926 | Coleman et al. | 281/34 |
| 3,318,354 | 5/1967 | Borisof | 402/15 |

FOREIGN PATENT DOCUMENTS

| | | | |
|---|---|---|---|
| 33742 | 9/1924 | Denmark | 281/34 |
| 625134 | 1/1936 | Fed. Rep. of Germany | 281/33 |
| 1522383 | 4/1968 | France | 281/34 |
| 527606 | 6/1955 | Italy | 281/34 |
| 600231 | 9/1957 | Italy | 281/34 |
| 396910 | 8/1933 | United Kingdom | 281/34 |

*Primary Examiner*—Paul A. Bell
*Assistant Examiner*—Paul M. Heyrana, Sr.
*Attorney, Agent, or Firm*—Antonelli, Terry & Wands

[57] ABSTRACT

A book cover which can be adapted to fit a wide range of sizes of books comprises a cover material adapted to be placed over the front and rear covers and the binding of the book to protect the book. Connectors are provided at two opposite ends of the cover material for connecting opposing sides of the cover material to one another to form sleeve-like configurations with the cover material adjacent the opposite ends which respectively receive the front and rear covers of the book in telescoping relationship. The portion of the cover material intermediate the opposite ends which are telescoped over the book covers is folded back and extends over the front and rear book covers and the book binding. A plurality of strips of material encircle each of the book covers to secure the portion of the cover material which is folded back and extends over the front and rear covers of the book to the adjacent covers. Stiffening members are placed over the covers of a paperback book so that it can be protected with the book cover.

9 Claims, 2 Drawing Sheets

BOOK COVER

BACKGROUND AND SUMMARY OF THE INVENTION

The present invention is directed to an improved book cover which can be adapted to protect a wide range of sizes of books without cutting or otherwise significantly altering the book cover.

Book covers have been known for many years. As an example, in a known book cover the cover material has ends with flaps which are folded over the respective covers of the book as in U.S. Pat. No. 295,996 to Getchell issued Apr. 1, 1884. One problem associated with such a book cover is that it is not able to fit a wide range of sizes of books. Further, the durability and fit of such known book cover may be less than satisfactory.

An object of the present invention is to provide an improved book cover which can be adapted to fit a wide range of sizes of books, for example, from small paperback books to books as large as a telephone directory, without significant alteration of the cover. A further object of the invention is to provide a book cover which is durable and which securely fits any book on which it is used.

These and other objects of the invention are attained by the book cover of the invention which comprises a cover material adapted to be placed over the front and rear covers and the binding of a book to protect a book, and means for connecting two opposite sides of said cover material to one another adjacent each of two opposite ends of said cover material for forming sleeve-like configurations with said cover material adjacent said opposite ends for respectively receiving the front and rear covers of the book in telescoping relationship with the portion of the cover material intermediate the opposite ends which are telescoped over the book covers being folded back and extending over the front and rear book covers and book binding.

According to a further feature of the invention, the book cover further comprises means for securing the portion of the cover material which is folded back and extends over the front and rear covers of the book to the adjacent covers. In a disclosed, preferred embodiment of the invention, the means for securing comprises a plurality of strips of material for encircling the cover material and respective ones of the book covers for securing the portion of the cover material to the adjacent covers. The ends of each strip of material are releasably secured to one another to facilitate placement and removal of the book cover. The length of each of the strips can be adjusted for accommodating different sized books. The strips are also preferably elastically yieldable for resiliently securing the cover material on the book covers.

An additional feature of the invention is that the length of the connecting means for connecting two opposite sides of the cover material to one another adjacent each of two opposite ends of the cover material for forming sleeve-like configurations with the cover material adjacent the opposite ends for respectively receiving the front and rear covers of the book in telescoping relationship, is adjustable. Further, the connecting means is preferably elastically yieldable for resiliently securing the ends of the cover material in telescoping relationship over the book covers. This, together with the use of the plurality of strips of material which encircle the respective covers of the book ensure a snug, secure fit of the cover of the invention on the book even though the size of book which is covered can be any size within a wide range of sizes.

The book cover is used in combination with stiffening members adapted to be placed over at least the front and rear covers of a paperback book to add structural integrity to the covers when a paperback book is to be covered. The stiffening can be formed of cardboard or plastic, for example.

These and other objects, features and advantages of the present invention will become more apparent from the following description with taken in connection with the accompanying drawings which show, for purposes of illustration only, one embodiment in accordance with the invention.

DETAILED DESCRIPTION OF THE DISCLOSED EMBODIMENT

Figure 1:
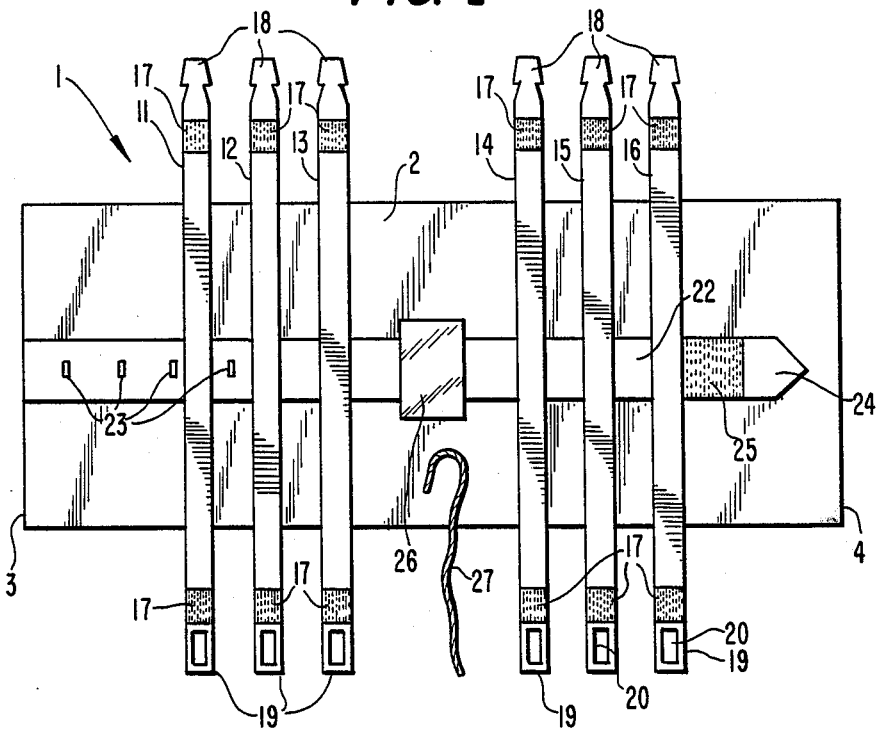
FIG. 1 is an elevational view of the outer side of the book cover of the invention with the attaching straps in an open condition.

Referring now to the drawings, a book cover 1 of the invention, which can be adapted to protect a wide range of sizes of books without cutting or otherwise significantly altering the book cover, is seen to comprise a cover material 2 having a rectangular form. The cover material may be a fabric, vinyl, leather, paper or other thin, flexible material which is readily adapted to be folded over itself and the front and rear covers and the binding of a book for accommodating books of different height as explained more fully below.

Figure 2:
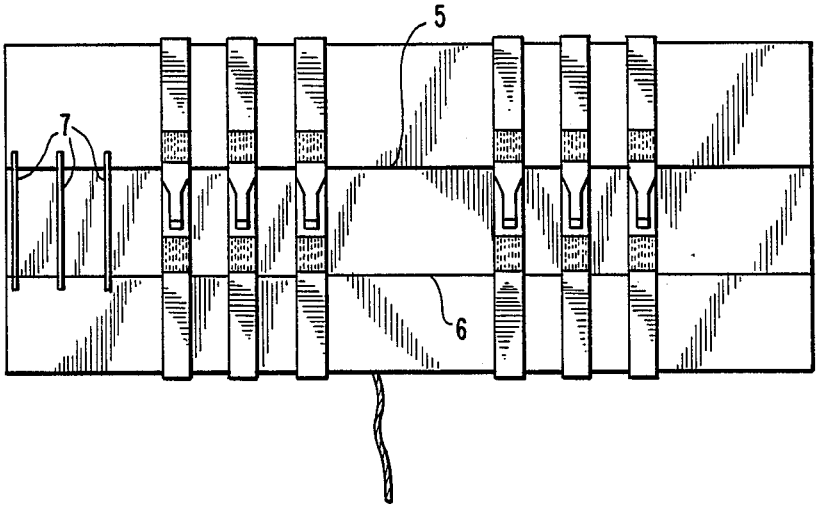
FIG. 2 is an elevational view of the inner side thereof with the attaching straps in a closed condition.
Figure 3:
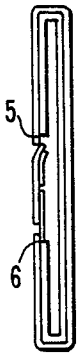
FIG. 3 is a right side elevational view of FIG. 2.
Figure 4:
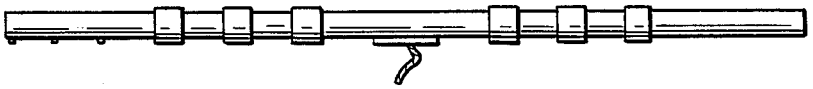
FIG. 4 is a bottom plan view of FIG. 2.
Figure 8:
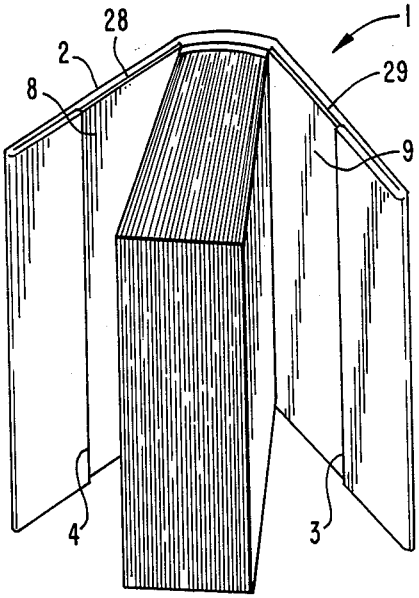
FIG. 8 is a perspective view of a paperback book with its covers open and the book cover of the invention placed thereon over stiffening members before addition of the attaching straps.

The cover material 2 has a left end 3 and a right end 4 as illustrated in FIGS. 1, 2 and 4. A top side 5 and a bottom side 6 of the cover material as illustrated in FIG. 2 have been folded inward so that the book cover has a height corresponding approximately to that of front and rear covers of the book upon which it is to be placed. The top and bottom sides 5 and 6 are connected to one another adjacent each of the left and right ends 3 and 4 of the cover material by means of connecting means 7 in the form of elastic bands. The elastic bands 7 are connected to the top and bottom sides 5 and 6 and form sleeve-like configurations with the cover material adjacent the left and right ends 3 and 4 for respectively receiving the front and rear covers, 8 and 9 as shown in FIG. 8, of a book, 10 in FIG. 8 in telescoping relation. The end of one of the sleeve-like configurations for receiving a book cover is shown in FIG. 3 of the drawings. The ends of the elastic connecting means 7 can be sewn, glued or otherwise attached to the top and bottom sides 5 and 6 adjacent the left and right ends 3 and 4. Because of the elastic nature of the connecting means, when the book cover is telescoped over the front and rear covers of the book, they resiliently secure the ends of the cover material on the book covers. To resist deformation of the front and rear covers of a book, where the book is a paperback book as shown in FIG. 8, stiffening members 28 and 29 formed of cardboard or plastic and in the shape of the front and rear covers, respectively, are provided between the cover 1 and the front rear covers 8 and 9.

Figure 5:
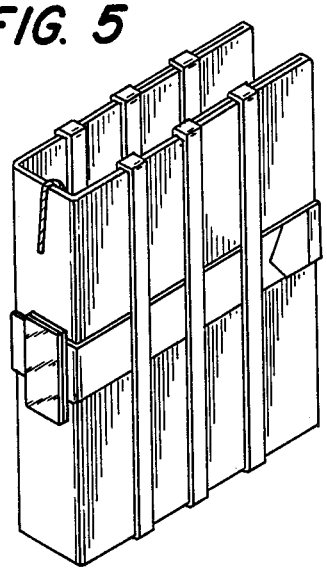
FIG. 5 is a top front perspective view thereof in its position of use on a book.
Figure 6:
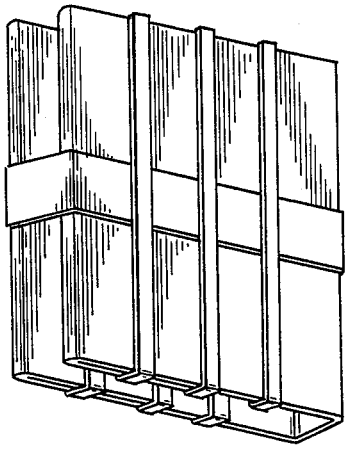
FIG. 6 is a bottom, rear perspective view of FIG. 5.

The extent to which the left and right ends 3 and 4 of the cover material can be telescoped over the front and rear covers of the book depends upon the width of the book since the portion of the cover material intermediate the opposite ends which are telescoped over the book covers is folded back and extends over the outer surfaces of the front and rear book covers and the book binding as can be understood from an examination of FIGS. 5, 6 and 8. Means for securing the portion of the cover material which is folded back and extends over the front and rear covers of the book and the stiffening member if used in the case of a paperback book to the adjacent covers are provided in the form of a plurality of strips of material 11 through 16 which may, for example, be formed of fabric with elastic portions 17 connected at respective ends of the fabric as by sewing or gluing. The outer ends of the elastic portions 17 in turn have male and female plastic fastener elements 18 and 19 connected thereto as by sewing or stapling, for example. The plurality of strips of material are adapted to encircle the cover material and respective ones of the front and rear book covers and stiffening members, if used, for securing the portion of the cover material intermediate the ends which are telescoped over the book covers, as well as the stiffening members, to the adjacent covers as can be readily seen from an examination of FIGS. 1, 2, 4, 5 and 6. The strips of material have not yet been placed on the book, stiffening members and book cover shown in FIG. 8. The stiffening members are not needed in the case of covering a hardback book.

Figure 7:
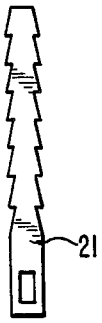
FIG. 7 is an elevational view of an extender for use with the attaching straps to accommodate larger books.

The fastener elements 18 and 19 can be releasably connected to one another by inserting the outer free end of the male fastener element 18 through the opening 20 in the corresponding female fastener element 19. The end of the element 18 has a width less than the longitudinal extent of the opening 20 but greater than the lateral extent thereof so that the end of the fastener element 18 will be retained in the fastener element 19 when the ends are longitudinally aligned as shown in FIG. 2. The strips of material 11 through 16 are elastically yieldable with respect to their length because of the presence of the elastic portions 17 for resiliently securing the cover material to the adjacent book covers. The length of the strips of material 11 through 16 can be adjusted for accommodating different sized books by the use of an intermediate fastener element 21, shown in FIG. 7, between the male and female elements 18 and 19. Alternatively, or in addition to the use of the intermediate fastener element 21, the male, plastic fastener elements 18 can be formed with a series of notched portions like the intermediate fastener element 21 to provide an adjustment of the length of the strips of material. The strips of material 11 through 16 can be attached as by sewing to specific locations along the cover material but preferably are unattached so that they can be adjustably positioned along the cover material over the book covers by the user when the book cover is mounted on the book in order to accommodate different sized books.

The number of strips of material used can vary from that shown in the illustrated embodiment of the invention. For example, two, four or more strips of material can be used for attaching the cover material to each of the front and rear covers of the book. In the illustrated embodiment, a single strip of material 22 extends from the left end 3 of the cover material to a location near the right end 4 thereof. As shown in FIG. 1, the left end of the strip of material, which may be fabric sewn to the cover material 2, carries small loops or eyelets 23 at several spaced locations. A small hook, not shown is attached to the underside of the free end 24 of the strip of the material 22 for releasably grasping one of the loops or eyelets 23 to hold the book cover and book in its closed position as shown in FIGS. 5 and 6. An elastic portion 25 is provided intermediate the free end 24 and the end of the fabric strip 22 for resiliently securing the book cover and book in its closed position. This is an optional feature on the book cover. A small plate 26 upon which identifying information can be placed is located over the strip of material 22 intermediate its ends. This plate is positioned over the book binding when the cover is placed on the book as shown in FIG. 5. A small strip of flexible material 27 is also attached at one end to the cover material of the book cover for use as a book marker as shown in the drawings. The plate 26 and book marker 27 can also be omitted on the book cover, if desired.

Thus, it can be readily seen that the improved book cover 1 of the invention can be adapted to protect a wide range of sizes of books without cutting or otherwise significantly altering the book cover. Paperback books can even be covered by use of the stiffening members. For ease of adjustment of the height of the book cover to correspond to that of the book upon which it is used, the connecting means 7 can be formed with fastener elements such as 18 and 19 with provision for adjusting the length thereof as with the use of an intermediate fastener element of the type shown in FIG. 7. Variations in the width of a book can be readily accommodated by simply changing the amount of the sleeve-like configurations at the ends of the cover material which are telescoped over the book covers. In this way, a single book cover of the invention can be adapted to cover, with a secure fit, books as small as small paperback books to those as large as a telephone directory.

While I have shown and described only one embodiment in accordance with the present invention, it is understood that the same is not limited thereto, but is susceptible to numerous changes and modifications as known to those skilled in the art. Therefore, I do not wish to be limited to the details shown and described herein, but intend to cover all such changes and modifications as are encompassed by the scope of the appended claims.

I claim:

1. A book cover for fitting a wide range of sizes of books comprising, in combination, a cover material for covering the front and rear covers and the binding of a book to protect the book, means for connecting two opposite sides of said cover material to one another adjacent each of two opposite ends of said cover material for forming sleeve-like configurations with said cover material adjacent said opposite ends for respectively receiving the front and rear covers of the book in telescoping relationship with the portion of said cover material intermediate said opposite ends which are telescoped over the book covers being folded back and extending over the front and rear book covers and book binding, and a plurality of strips of material which are unattached to the cover material for encircling said front and rear book covers and the cover material at the intermediate portion of the cover material, at least a portion of each of said strips of material being elastically yieldable for snugly securing said intermediate portion of the cover material to the adjacent cover.

2. A book cover according to claim 1, wherein each of said strips of material is formed with ends which are releasably connected to one another.

3. A book cover according to claim 1, wherein said strips of material include intermediate fastener elements for selectively adjusting the length of said strips for accommodating different sized books.

4. A book cover according to claim 1, wherein the length of said connecting means is adjustable for accommodating different sized books.

5. A book cover according to claim 1, wherein said connecting means is elastically yieldable for resiliently securing the ends of the cover material in telescoping relation over the covers of the book.

6. A book cover according to claim 1 further comprising, in combination, stiffening means for placing over at least the front and rear covers of the book beneath the cover material to add structural integrity to said covers.

7. A book cover according to claim 6, wherein said stiffening means are individual members positioned over the respective covers of the book.

8. A book cover according to claim 7, wherein said stiffening members are formed of plastic.

9. A book cover according to claim 6, wherein said stiffening members are formed of cardboard.

* * * * *